US006398696B1

(12) United States Patent
Tsou

(10) Patent No.: US 6,398,696 B1
(45) Date of Patent: Jun. 4, 2002

(54) RUNNING EXERCISER STRUCTURE

(75) Inventor: Chun Hung Tsou, Kaohsiung (TW)

(73) Assignee: Alilife Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 09/729,223

(22) Filed: Dec. 5, 2000

(51) Int. Cl.[7] ..... A63B 22/02
(52) U.S. Cl. ..... 482/54
(58) Field of Search ..... 482/51, 54

(56) References Cited

U.S. PATENT DOCUMENTS 4,844,449 A * 7/1989 Truslaske ..... 482/54
5,833,577 A * 11/1998 Hurt ..... 482/54
5,921,893 A * 7/1999 Hurt ..... 482/54

* cited by examiner

*Primary Examiner*—Stephen R. Crow
(74) *Attorney, Agent, or Firm*—Rosenberg, Klein & Lee

(57) ABSTRACT

A Running exerciser structure including a base seat, a frame body and two rocking arms. Two support stems respectively upward extend from two sides of the base seat. Two vertical slide rails are respectively disposed on the support stems. Two sides of the frame body are respectively disposed with two rollers which can vertically roll along the slide rails. Two rocking arms are respectively pivotally disposed on two sides of the frame body and interconnected by a shaft. Two ends of the shaft are respectively disposed with two rollers. A telescopic rod is pivotally disposed between the frame body and the shaft. When a second motor drives the telescopic rod to extend, the rocking arms are driven to swing to elevate or lower the frame body. When the frame body is lifted, the rocking arms, telescopic rod and the frame body form a firm triangular supporting structure for stably supporting the running exerciser.

4 Claims, 6 Drawing Sheets

RUNNING EXERCISER STRUCTURE

BACKGROUND OF THE INVENTION

The present invention is related to an improved running exerciser having simple structure and better supporting strength.

FIG. 9 shows a conventional running exerciser including a frame body 81, a base seat 82, a connecting member 83, a telescopic rod 84 and an elevating member 9. The base seat 82 is pivotally connected with one end of the connecting member 83. The other end of the connecting member 83 is pivotally connected with the frame body 81 by a pivot member 811. The elevating member 9 has a pivot section 91 connected with the base seat 82. The pivot section 91 is pivotally connected with a driven section 93. A driving section 92 is disposed on the driven section 93 and connected with the telescopic rod 84. The telescopic rod 84 is a thread rod driven by a motor 85 to extend or retract. When the telescopic thread rod 84 is driven, the force driving section 92 pushes the driven section 93 to swing and lift the base seat 82.

FIG. 10 shows that the elevating member 9 lifts the base seat 82. The base seat 82 is pivotally connected with the connecting member 83. Therefore, when the connecting member 83 is swung, the base seat 82 is moved along an arch path. That is, when a user runs on the base seat 82, the pressure exerted onto the base seat 82 will form an action force making the base seat 82 move upward along an arch path. In other words, the pressure exerted onto the base seat 82 has a vertical and a horizontal components which both are borne by the elevating member 9. The pivot section 91 of the elevating member 9 is connected with the base seat 82 and the driving section 92 is connected with the telescopic rod 84. The driven section 93 swings to retain the base seat 82. When the elevating member 9 suffers the vertical and horizontal components of action force, the action force of the pivot section 91, driving section 92 and driven section 93 will be concentrated on the adjoining point A of the pivot section 91, driving section 92 and driven section 93 as shown in FIG. 10. This often leads to bending and deformation or even breakage of the driving section 92 and the driven section 93. Therefore, the safety in use can be hardly ensured. Moreover, the elevating member 9 has complicated structure. This leads to higher manufacturing cost.

SUMMARY OF THE INVENTION

It is therefore a primary object of the present invention to provide an improved running exerciser structure in which the rollers of the frame body are mounted in the vertical slide rails of the base seat, whereby the frame body is restricted by the slide rails and can be only moved up and down. The rocking arms, telescopic rod and the frame body form a firm triangular supporting structure. Therefore, the slide rails and the rollers serve to bear the horizontal component of the force exerted onto the frame body, while the rocking arms and the telescopic rod only need to bear the vertical component of the force exerted onto the frame body. Therefore, a better supporting effect is provided.

It is a further object of the present invention to provide the above running exerciser in which the telescopic rod directly pushes the rocking arms to swing and lift or lower the frame body. Therefore, the structure is simplified and the manufacturing cost is reduced.

The present invention can be best understood through the following description and accompanying drawings wherein:

DETAILED DESCRIPTION OF THE PREFERRED EMBODIMENTS

Figure 1:
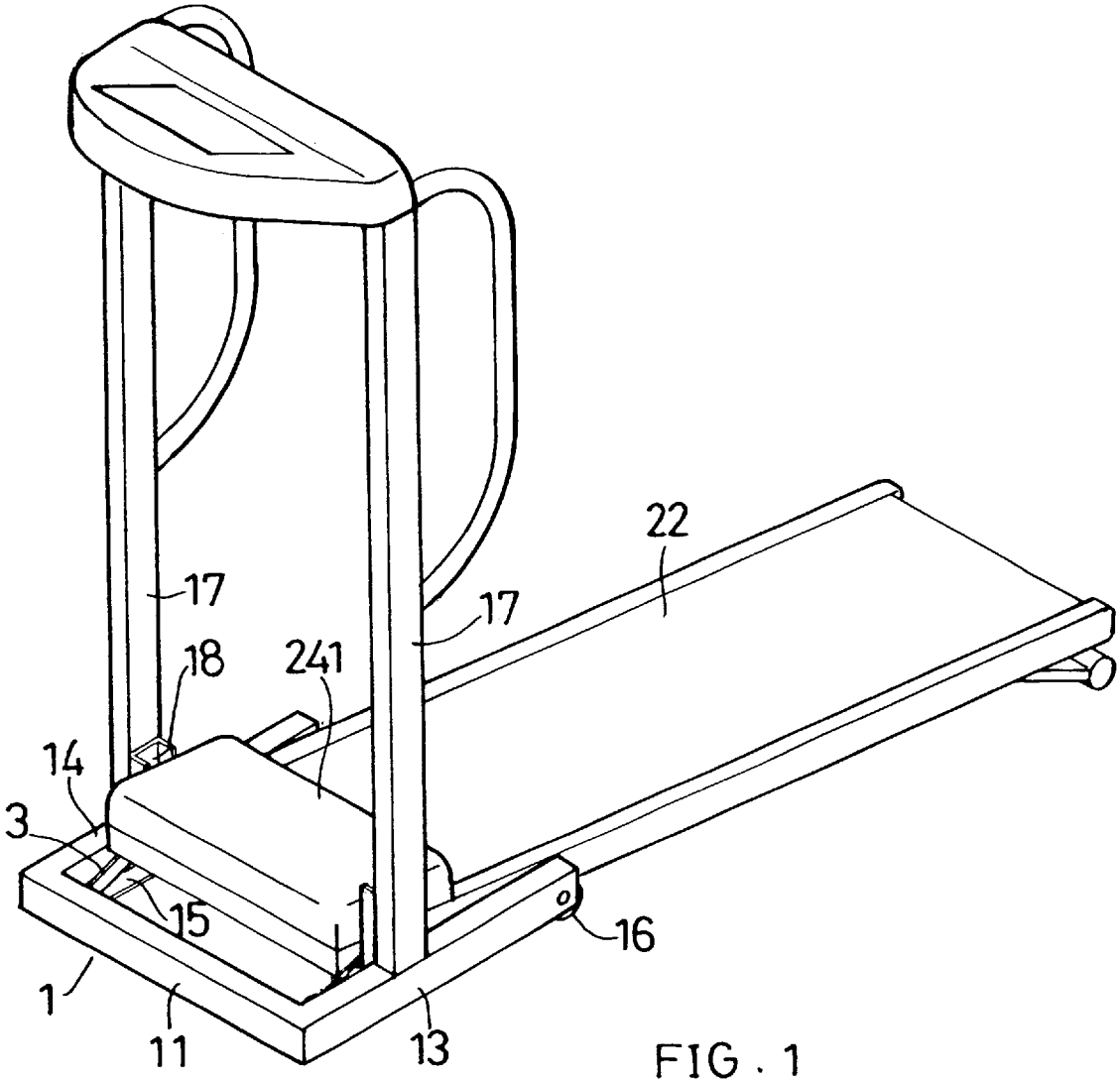
FIG. 1 is a perspective view of the present invention.
Figure 2:
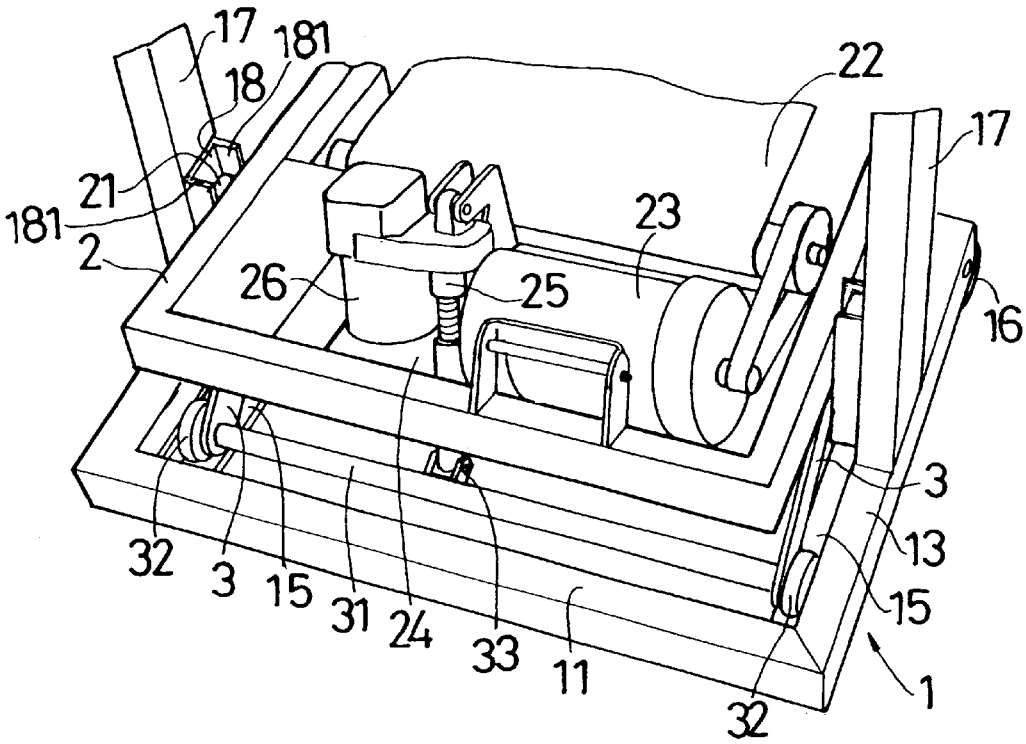
FIG. 2 is a perspective view of a part of the present invention.

Please refer to FIGS. 1 to 8. The running exerciser structure of the present invention includes:

a base seat 1 rested on the ground, the base seat 1 being composed of a front bar 11, a rear bar 12, a left bar 13 and a right bar 14, a pair of rails 15 being disposed on opposite inner sides of the left and right bars 13, 14 between the front and rear bars 11, 12, a wheel 16 being disposed at rear end of each of the left and right bars 13, 14, whereby when the base seat 1 is tilted, the wheels 16 contact with the ground to facilitate movement thereof, the middle portions of the left and right bars 13, 14 respectively having two upward extending support stems 17, the bottom portions of the opposite sides of the two support stems 17 being respectively disposed with two vertical slide rails 18, each slide rail 18 having two parallel vertical guide plates 181;

a frame body 2, a front section of the frame body 2 being disposed between the two support stems 17 of the base seat 1, two sides of the front section of the frame body 2 being respectively disposed with two rollers 21 corresponding to the slide rails 18, whereby the frame body 2 can be vertically slided between the base seat 1, a running belt 22 being disposed in the frame body 2 and circularly driven by a first motor 23, the front section of the frame body 2 having a receptacle 24 covered by a cover 241, a telescopic rod 25 being pivotally disposed in the receptacle 24, in this embodiment, the telescopic rod 25 being a thread rod, the telescopic rod 25 being driven by a power source 26 which can be a motor; and two rocking arms 3 disposed on front bottom sections of the frame body 2, one end of the rocking arms 3 being respectively pivotally connected with the pivot sections 27 on two sides of the frame body 2, the other ends of the rocking arms 3 being connected by a shaft 31, two ends of the shaft 31 being respectively disposed with two rollers 32 rolling along the rails 15 of the base seat 1, a pivot seat 33 being disposed on the shaft 31 for pivotally connecting with the telescopic rod 25 which is pivotally disposed on the frame body 2.

Figure 3:
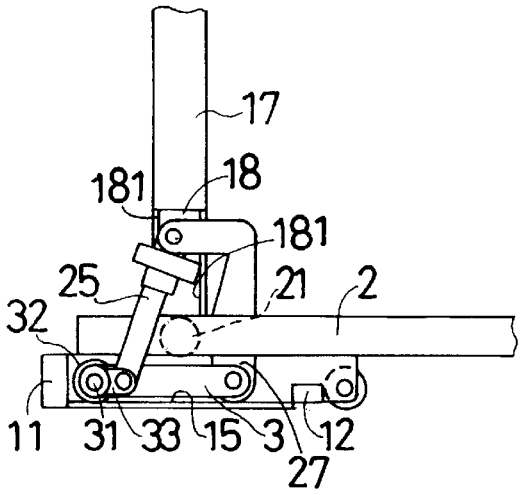
FIG. 3 is a plane view of the present invention, showing that the frame body is not yet elevated.
Figure 4:
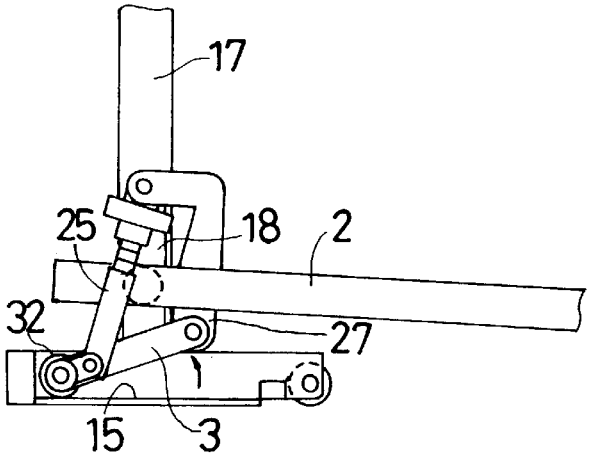
FIG. 4 is a plane view of the present invention, showing that the frame body is elevated.
Figure 5:
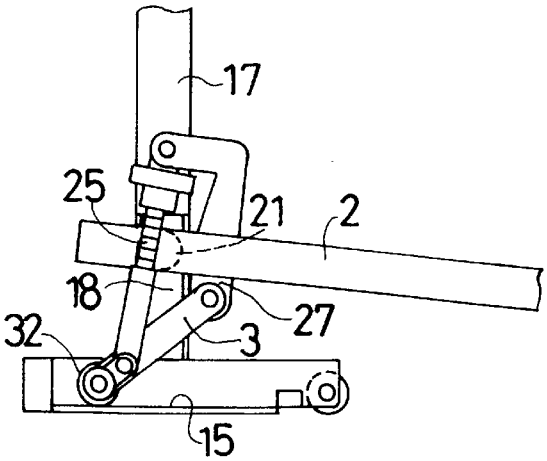
FIG. 5 is a plane view of the present invention, showing that the frame body is elevated to a top position.

FIG. 3 shows that the frame body 2 is not elevated yet. When a user desires to elevate the frame body 2, the second motor 26 drives the telescopic rod 25 to extend and make the rocking arms 3 swing. At this time, as shown in FIG. 4, the front end of the frame body 2 is gradually lifted. When the telescopic rod 25 continuously extends, the rocking arms 3 are continuously swung to drive and lift the frame body 2. The rollers 21 of the frame body 2 are restricted by the guide plates 181 of the slide rail 18 and can only move within the slide rail 18. Therefore, when the rocking arms 3 are swung downward, the rollers 32 will move backward along the rails 15 to push and lift the frame body 2 as shown in FIG. 5. Therefore, the frame body 2 is tilted with front end higher and the rear end lower for a user to easily run thereon.

The rollers 21 of the frame body 2 are mounted in the vertical slide rails 18 of the base seat 1, whereby the frame body 2 is restricted by the slide rails 18 and can be only moved up and down. Moreover, the rocking arms 3, telescopic rod 25 and the frame body 2 form a triangular supporting structure. Therefore, the slide rails 18 and the rollers 21 serve to bear the horizontal component of the force exerted onto the frame body 2, while the rocking arms 3 and the telescopic rod 25 only need to bear the vertical component of the force exerted onto the frame body 2. Therefore, a better supporting force is provided. In addition, the telescopic rod 25 is pivotally disposed on the pivot seat 33 of the shaft 31 so that the force application arm is longer to avoid stress concentration of the pivot seat 33.

Figure 6:
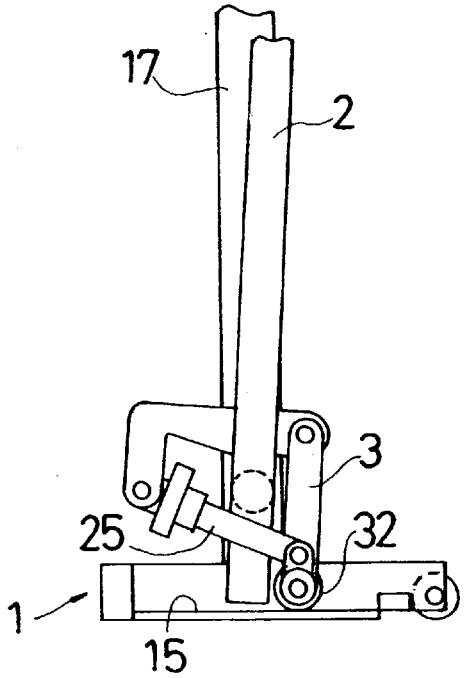
FIG. 6 is a plane view of the present invention, showing that the frame body is turned upward.
Figure 7:
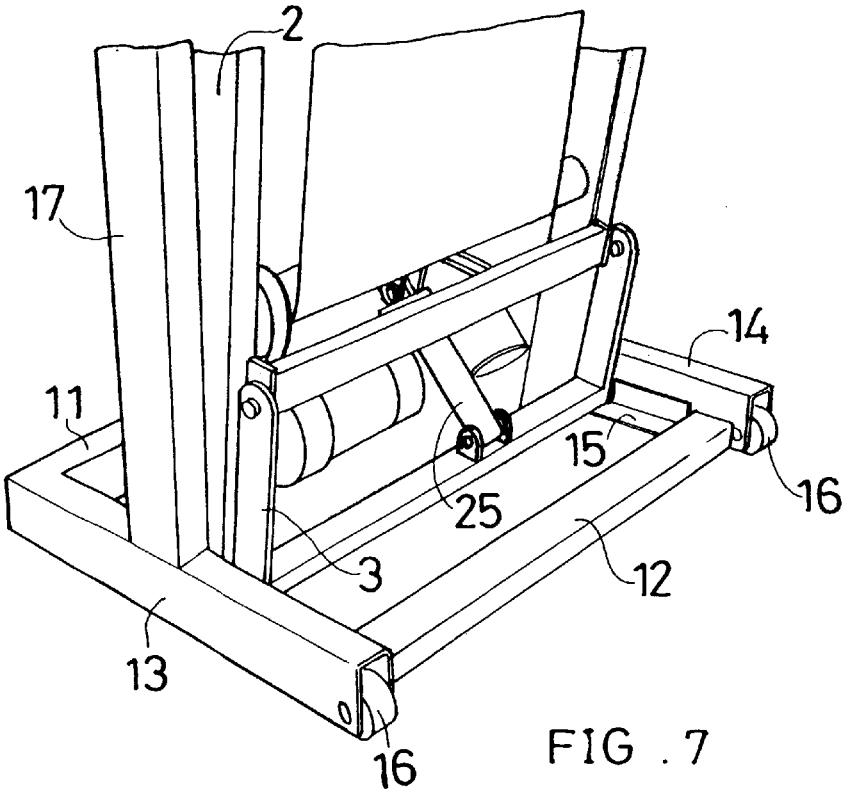
FIG. 7 is a perspective view of apart of the present invention, showing that the frame body is turned upward.
Figure 8:
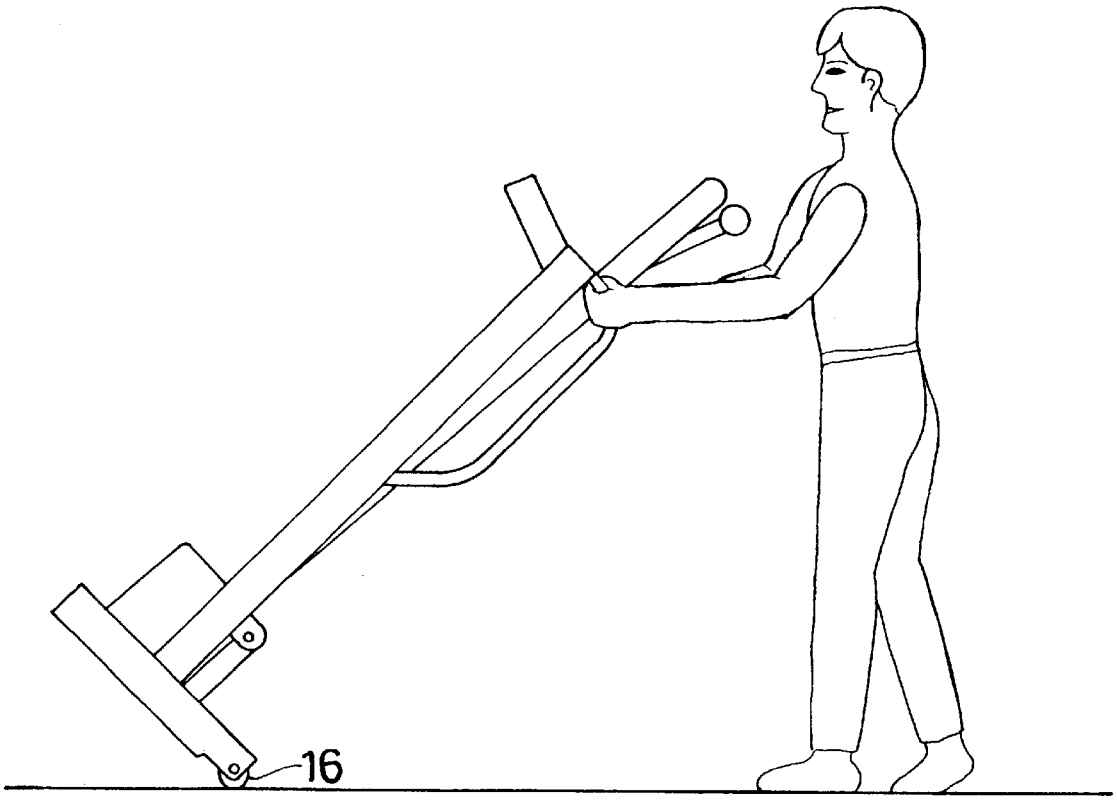
FIG. 8 shows that the running exerciser of the present invention is moved.
Figure 9:
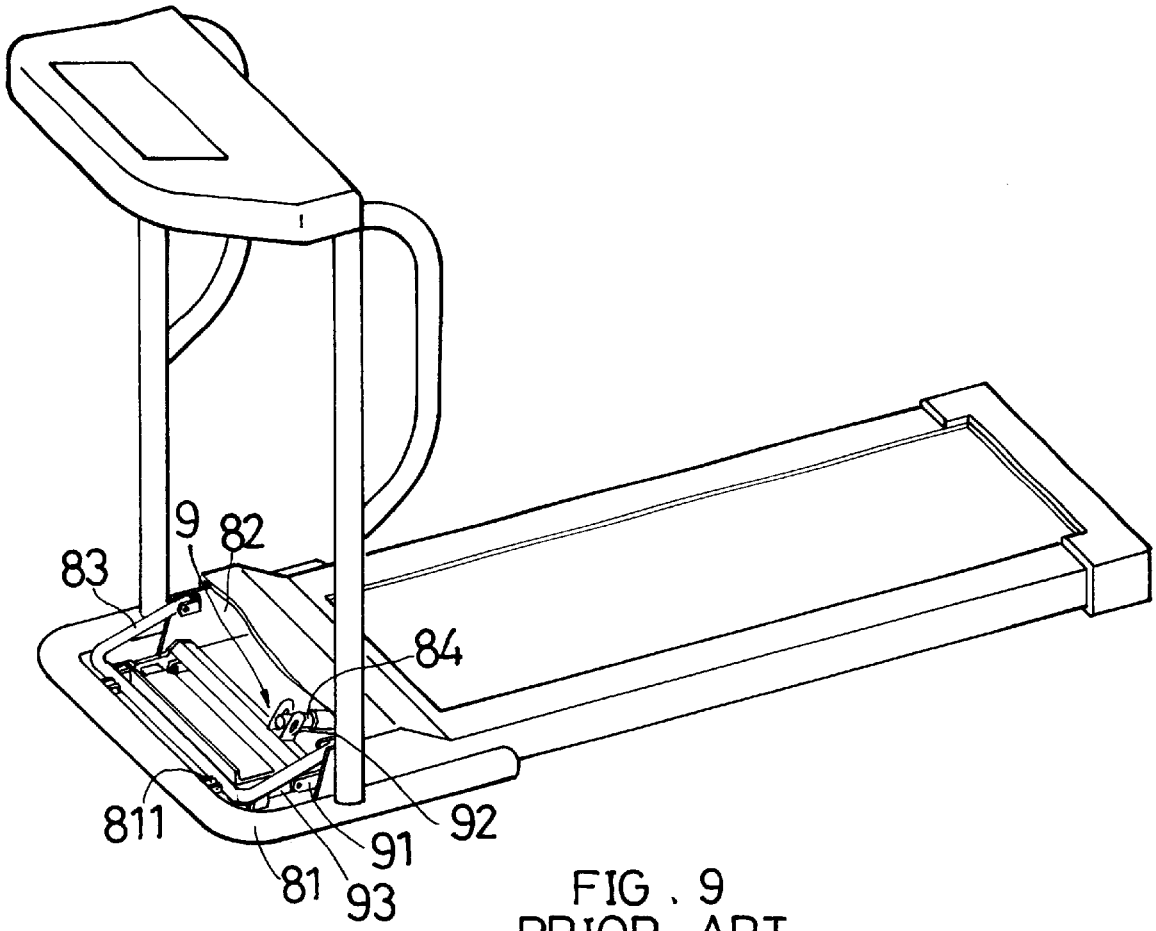
FIG. 9 PRIOR ART
FIG. 9 is a perspective view of a conventional running exerciser.
Figure 10:
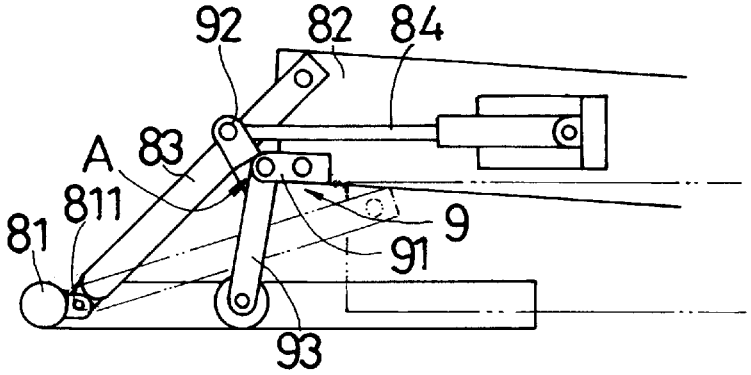
FIG. 10 PRIOR ART
FIG. 10 is a plane view of the conventional running exerciser, showing that the elevating member lifts the base seat.

Furthermore, when moving the running exerciser, the rear end of the frame body 2 is lifted and turned upward about the rollers 21 as shown in FIGS. 6 and 7. At this time, the rollers 32 of the rocking arms 3 will move backward along the rails 15. Also, the rollers 32 are leant against the rails 15 to support the weight of the frame body 2. Then the base seat is tilted to make the wheels 16 of the rear ends of the left and right bars 13, 14 contact with the ground as shown in FIG. 8. Under such circumstance, the running exerciser can be easily moved.

In conclusion, the rollers 21 of the frame body 2 are restricted by the slide rails 18, whereby the frame body 2 can be only moved up and down. Therefore, the slide rails 18 and the rollers 21 serve to bear the horizontal component of the force exerted onto the frame body 2, while the rocking arms 3 and the telescopic rod 25 only need to bear the vertical component of the force exerted onto the frame body 2. Therefore, a better supporting force is provided. Furthermore, the telescopic rod 25 directly pushes the rocking arms 3 to swing and lift or lower the frame body 2. The structure is simplified and the manufacturing cost is reduced.

The above embodiments are only used to illustrate the present invention, not intended to limit the scope thereof. Many modifications of the above embodiments can be made without departing from the spirit of the present invention.

What is claimed is:

1. A treadmill exerciser structure comprising:

a base seat supported on a base surface, said base seat having two sides with two support stems respectively extending upwardly therefrom, each of the support stems having a respective bottom portion, the base seat including two vertical slide rails respectively coupled to the bottom portion of the support stems;

a frame body, the frame body having a front section disposed between the two support stems, the frame body including two rollers respectively coupled to opposing sides of the front section in correspondence to the slide rails of the base seat, whereby the frame body can be slid vertically between the base seat, a continuous running belt being disposed in the frame body and driven by a first motor, a telescopic rod being pivotally disposed on the frame body, the telescopic rod being driven by a power source, the opposing sides of the front section each having a pivot section extending therefrom; and two rocking arms, one end of each of the rocking arms being respectively pivotally connected with a corresponding one of the pivot sections of the frame body, an other end of each of the rocking arms being connected by a shaft, the shaft having two ends respectively disposed with two rollers, a pivot seat being disposed on the shaft for pivotally connecting with the telescopic rod.

2. The treadmill exerciser structure as claimed in claim 1, wherein the base seat is composed of a front bar, a rear bar, a left bar and a right bar, a pair of rails being respectively disposed on opposite inner sides of the left and right bars for the rollers at the two ends of the shaft to respectively roll along the pair of rails.

3. The treadmill exerciser structure as claimed in claim 1, wherein rear ends of two sides of the base seat are respectively disposed with two wheels, whereby when the base seat is tilted, the wheels contact the base surface to facilitate movement of the base seat.

4. The treadmill exerciser structure as claimed in claim 1, wherein the telescopic rod is a threaded rod.

* * * * *